US012644663B2

(12) United States Patent
Chu et al.

(10) Patent No.: US 12,644,663 B2
(45) Date of Patent: Jun. 2, 2026

(54) TRIGGER RESET DEVICE

(71) Applicant: MAN KUNG ENTERPRISE CO., LTD., Taichung (TW)

(72) Inventors: Fu-Hui Chu, Taichung (TW); Ching-Chi Hung, Taichung (TW)

(73) Assignee: MAN KUNG ENTERPRISE CO., LTD., Taichung (TW)

( * ) Notice: Subject to any disclaimer, the term of this patent is extended or adjusted under 35 U.S.C. 154(b) by 203 days.

(21) Appl. No.: 18/733,195

(22) Filed: Jun. 4, 2024

(65) Prior Publication Data

US 2025/0369721 A1 Dec. 4, 2025

(51) Int. Cl.
*F41B 5/14* (2006.01)
*F41B 5/12* (2006.01)

(52) U.S. Cl.
CPC ..... *F41B 5/1469* (2013.01); *F41B 5/12* (2013.01)

(58) Field of Classification Search
CPC ..... F41B 5/1469
USPC ..... 124/25
See application file for complete search history.

(56) References Cited

U.S. PATENT DOCUMENTS 6,736,123 B1 * 5/2004 Summers ..... F41B 5/1469 124/40
11,009,310 B1 * 5/2021 Shaffer ..... F41B 5/123
11,808,545 B1 * 11/2023 Chu ..... F41B 5/1469

* cited by examiner

*Primary Examiner* — Reginald S Tillman, Jr.
(74) *Attorney, Agent, or Firm* — Demian K. Jackson; Jackson IPG PLLC

(57) ABSTRACT

A trigger reset device includes a trigger block with a front end and a rear end, a hooker and a link trigger pivoted to the trigger block, and a safety switch being displaceably switchable between an open position and a closed position, and further includes a linkage part, a button and a retractor. The button can be operated to allow the linkage part to displace upward, and the retractor can stop and position the linkage part, drive the link trigger to pivot the linkage part, and separate the hooker, in order to achieve a trigger reset function, which makes the operation more convenient and quicker, and also improves the operation efficiency, and the design is simple and easy to operate, which prolongs the service life of the product and reduces the costs of subsequent maintenance and replacement.

10 Claims, 17 Drawing Sheets

TRIGGER RESET DEVICE

BACKGROUND

Technical Field

The present disclosure relates to a trigger device, more particularly relates to a crossbow trigger reset device.

Description of Related Art

Although the striking mechanism of existing crossbows can provide the archery effect and prevent an arrow from being fired by triggering the safety switch accidentally. When the bowstring is stretched and hooked on the hook and arrows are not loaded into the striking mechanism, the bowstring may be detached from the hook if the trigger is wrong triggered by the user and the arrow will be released, resulting in a dry fire situation where the energy of the bowstring is not able to be converted into the speed of arrows, and can only be absorbed by the crossbow itself, increasing the risk of breakage of the crossbow arm and bowstring due to the inability to withstand the energy, which not only shortens the service life of the crossbow but also poses a potential danger to the user or people around.

To avoid the above issue, current crossbows incorporate a trigger anti-dry-fire device to prevent the trigger from being pulled inadvertently when the bowstring is strung before the arrow is attached to the body of the crossbow, thus increasing the safety of the crossbows in use. However, when it is time to release the bowstring, the trigger anti-dry-fire device will cause obstruction and make it impossible to release the bowstring easily, thus causing a nuisance in the use of the crossbow.

To solve the above problem, there is a conventional trigger reset device used to pull back the bowstring by a blow tensioning device to separate the bowstring from the hooker after the bowstring has been wound, with the safety switch in the closed position, and then press and hold the brake switch, together with the operation of pressing the button, so as to cause the button to move the linkage part upward, and then drive the link trigger to disengage from the hooker and allow the bowstring to restore its original position and to realize the reset action.

However, the complicated structure of the conventional trigger reset device is troublesome and inconvenient to operate, thus affecting the user's operation efficiency and making it difficult for the product to become popular. Due to the complicated connection and operation mode among the components, once one of the components is damaged, the operation of the whole system of the product may be affected, thereby shortening the service life and increasing the costs of subsequent maintenance and replacement of the product.

SUMMARY

In view of the aforementioned deficiencies of the related art, it is a primary objective of the present disclosure to provide a trigger reset device, including: a trigger block, with a front end and a rear end, and comprising an arrow placement channel extending backward from a middle section of the front end, a hooker pivoted into the trigger block, a safety switch installed at a rear side of the arrow placement channel inside the trigger block, the safety switch being displaceably switchable between an open position and a closed position and having at least one slide rod extending from the safety switch, and a driving part arranged on the safety switch, the trigger block being provided with a link trigger pivoted to the inside of the trigger block and near the bottom of the trigger block, an end of the link trigger being provided with a hooking part for hooking the hooker, another end of the link trigger being provided with a link part, the trigger block comprising a linkage part receiving slot formed inside thereof and near the rear end thereof, the linkage part receiving slot comprising a displacement means, and the trigger block comprising a retractor receiving slot formed therein and configured to be corresponsive to the linkage part receiving slot; a linkage part, displaceably installed in the linkage part receiving slot of the trigger block, and having a link slot formed at the linkage part near a lower end of the linkage part, and engaged and linked with the link part of the link trigger, and a controlled part arranged at an upper end of the linkage part; a button, combined with the controlled part of the linkage part, and linked with the displacement means, and capable of driving the linkage part to move upward by pressing the button in conjunction with the displacement means, and displacing the linkage part downward to restore to its original position by releasing the button; and a retractor, installed in the retractor receiving slot of the trigger block, and comprising a positioning retainer disposed on the retractor and arranged towards an end of the linkage part, a driven part extending downward and driven by the driving part of the safety switch, and a retractor spring installed between the retractor and the trigger block, wherein the retractor is pushed by the elastic force of the retractor spring towards the linkage part to abut the linkage part; thereby, the button can be pressed to drive the linkage part to move upward, and then the linkage part drives the link trigger away from the hooker, while the linkage part and the retractor are staggered, and the retractor is moved toward the linkage part by the retractor spring, so as to block the linkage part by the positioning retainer of the retractor.

It is a primary objective of the present disclosure to allow users to separate the link trigger from the hooker simply by pressing the button to complete a reset operation easily, conveniently and quickly, so as to improve the operating efficiency.

Another objective of the present disclosure is to simplify the connection and operation of the components, to prolong the service life of the product, and reduce the costs of subsequent repairs and replacements.

DESCRIPTION OF THE EMBODIMENTS

Figure 1:
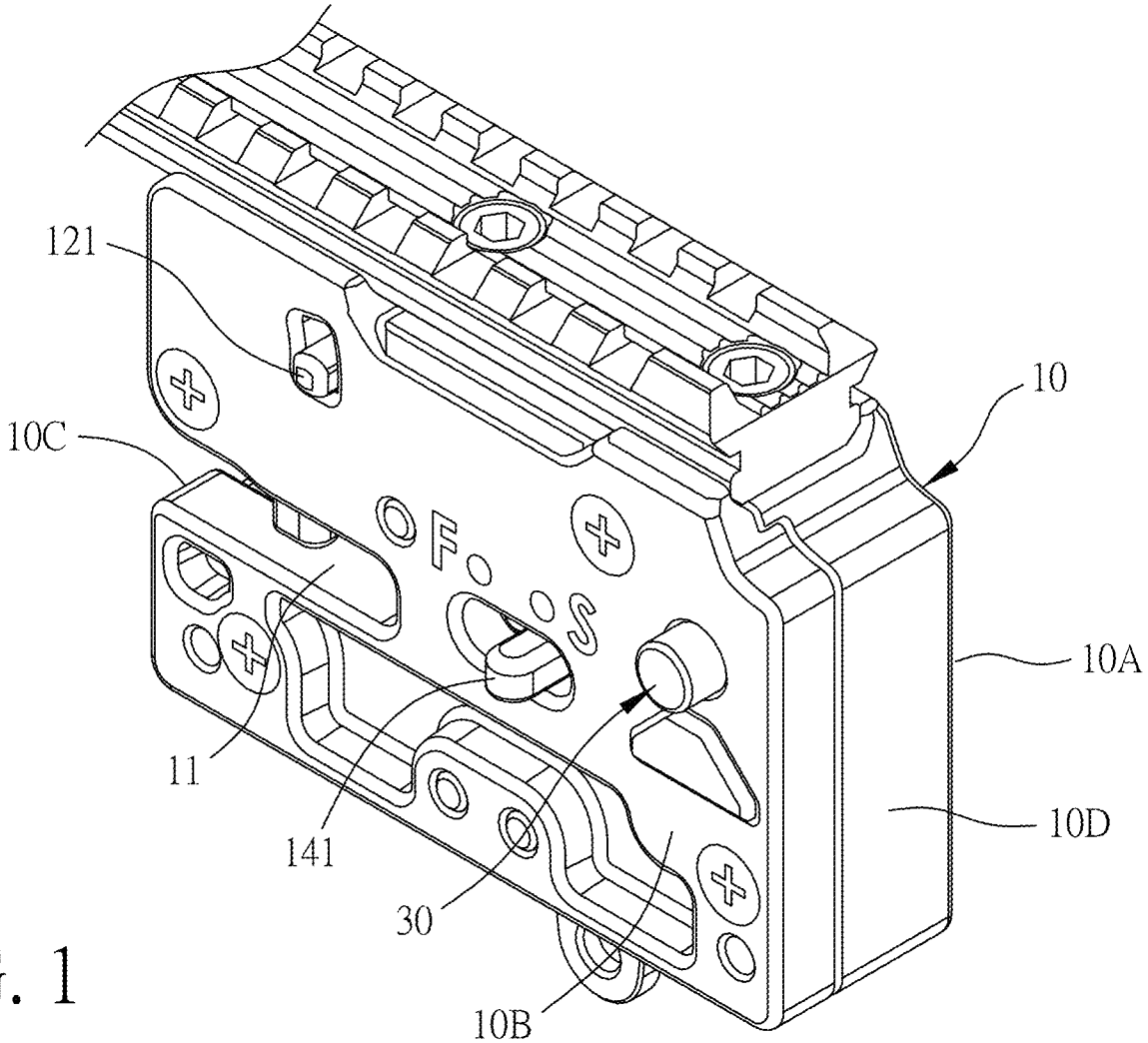
FIG. 1 is a perspective view of the present disclosure.
Figure 2:
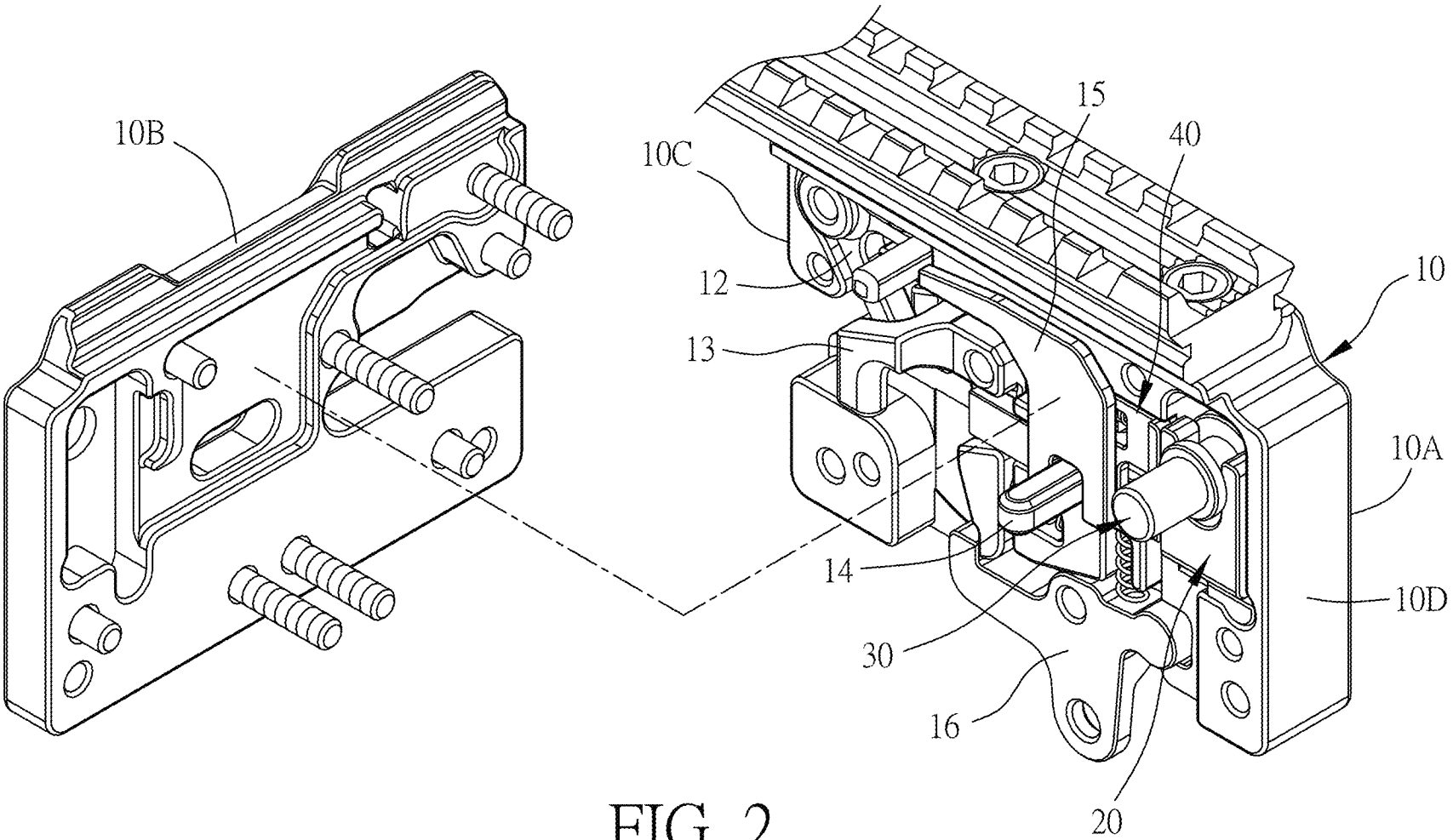
FIG. 2 is a disassembled view of the present disclosure.
Figure 3:
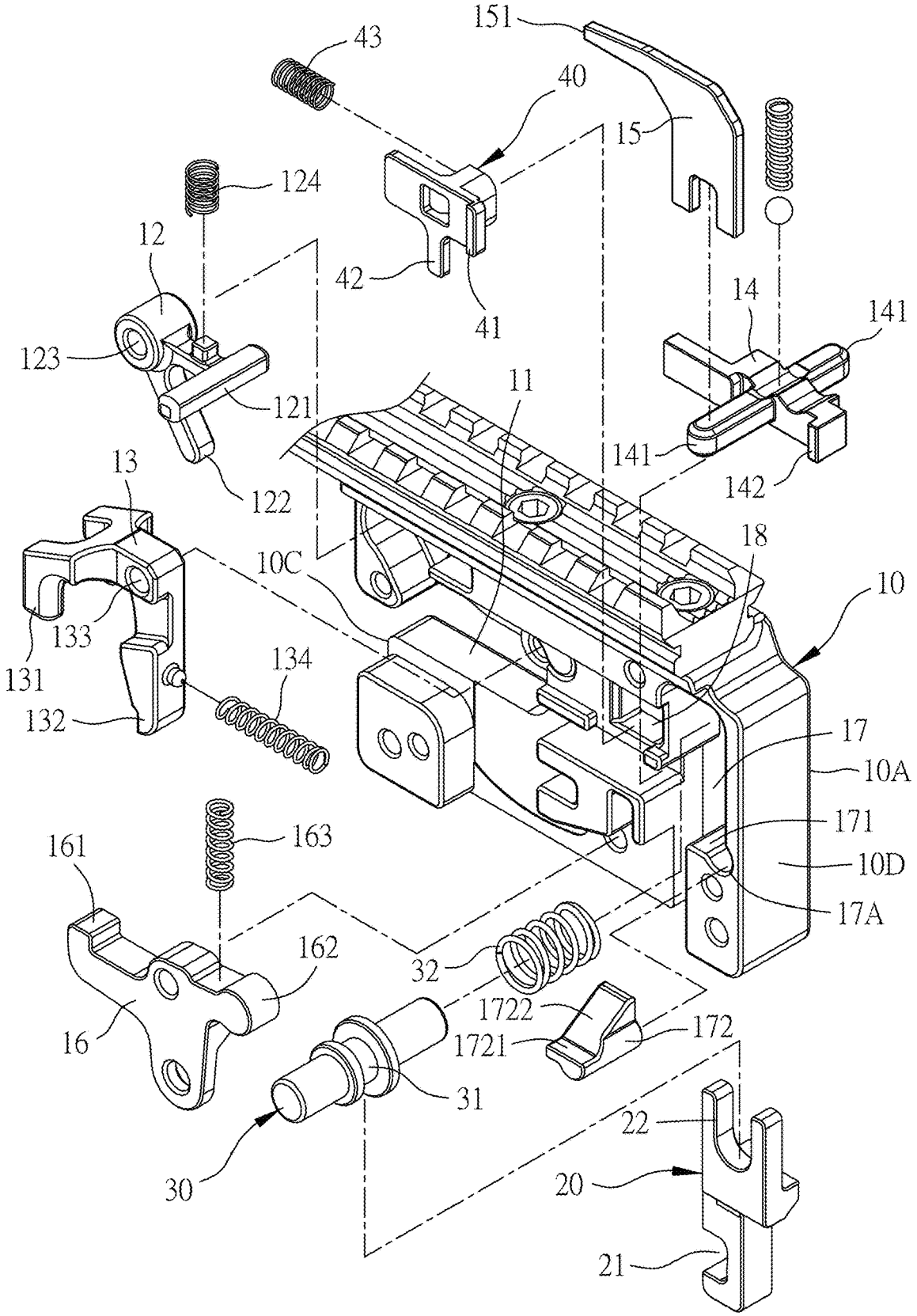
FIG. 3 is an exploded view of the present disclosure.
Figure 4:
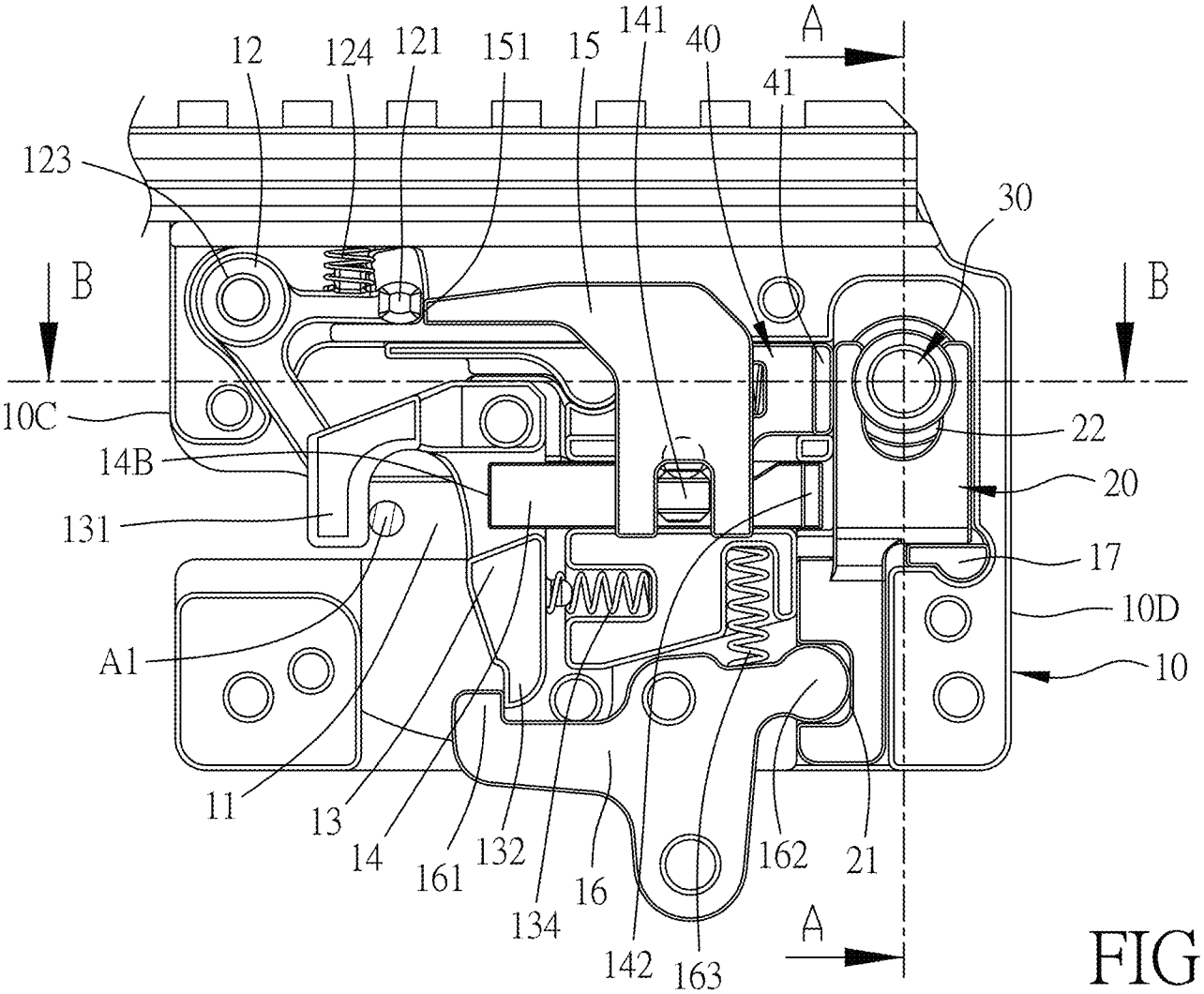
FIG. 4 is a planar view of the present disclosure before an arrow is nocked on a bowstring.
Figure 5:
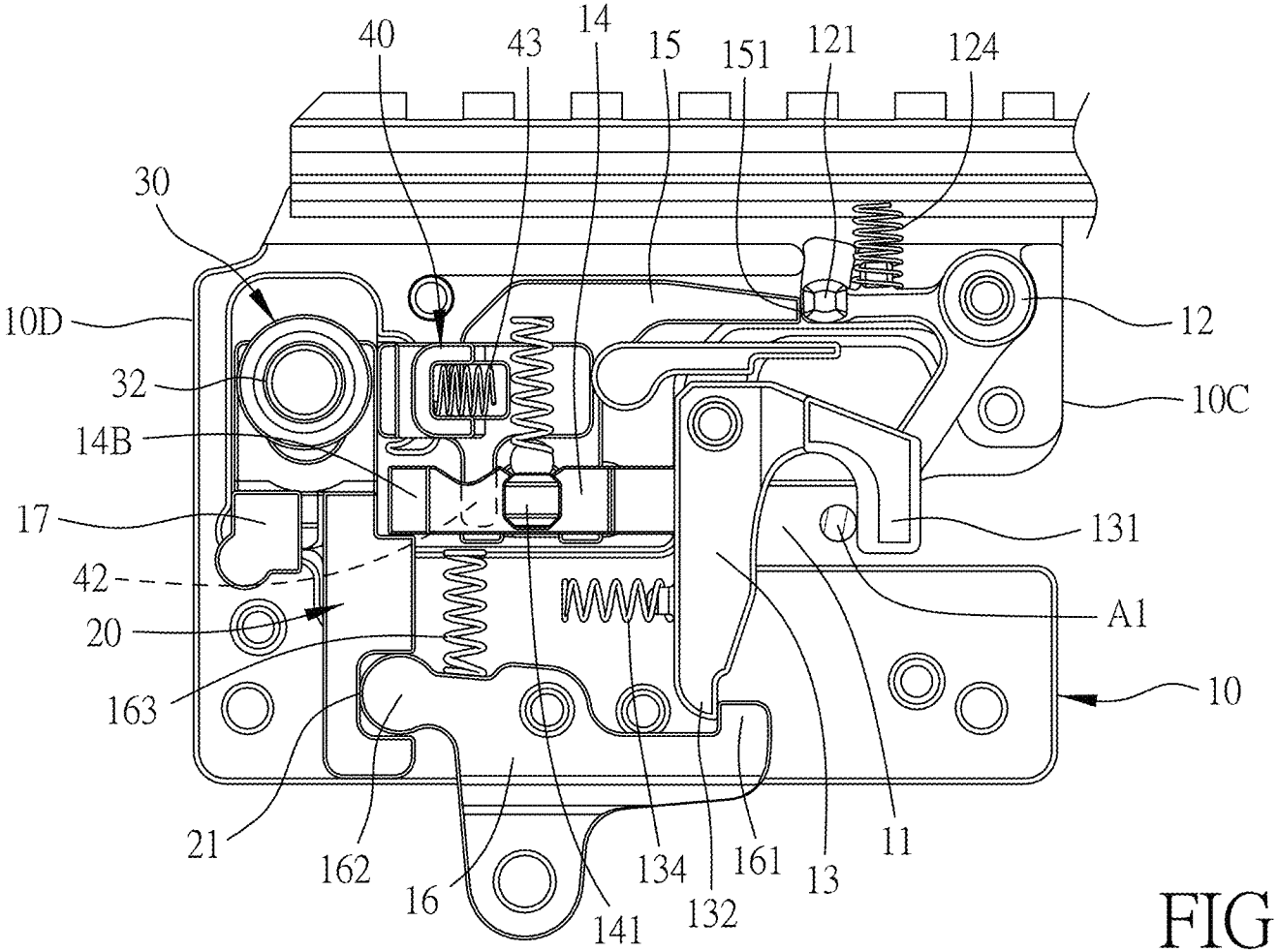
FIG. 5 is another planar view of the present disclosure before an arrow is nocked on a bowstring.
Figure 6:
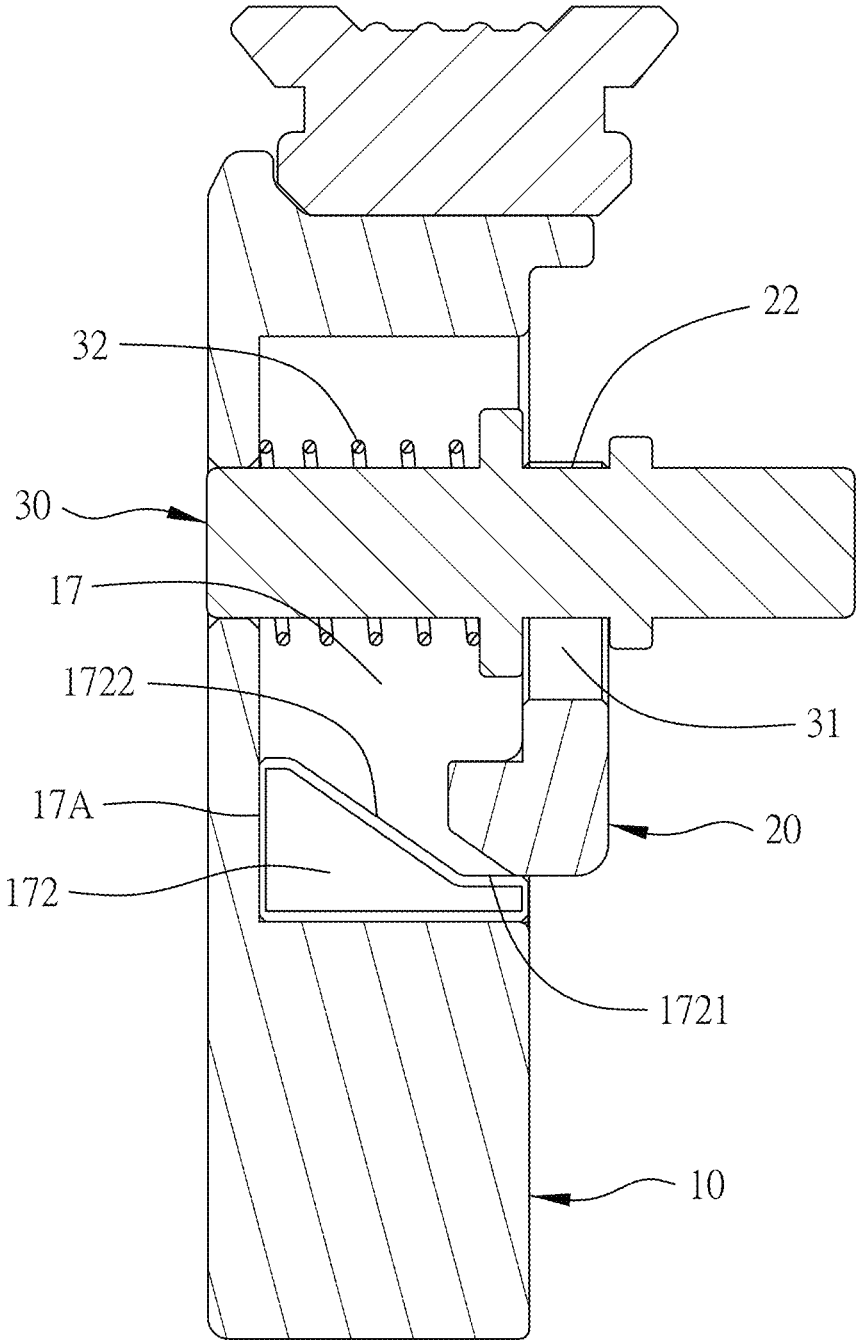
FIG. 6 is a cross-section view of Section A-A of FIG. 4.
Figure 7:
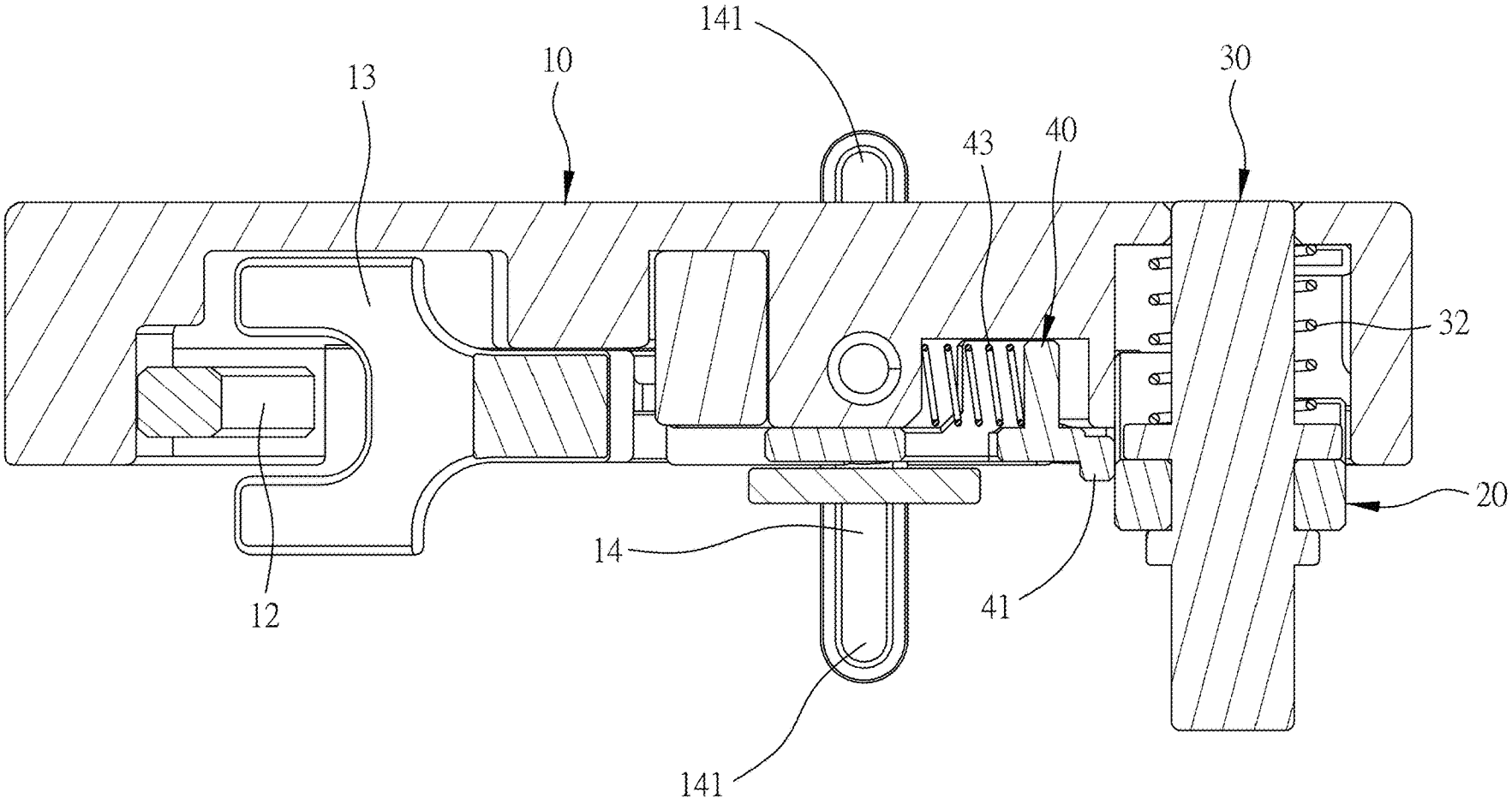
FIG. 7 is a cross-section view of Section B-B of FIG. 4.
Figure 8:
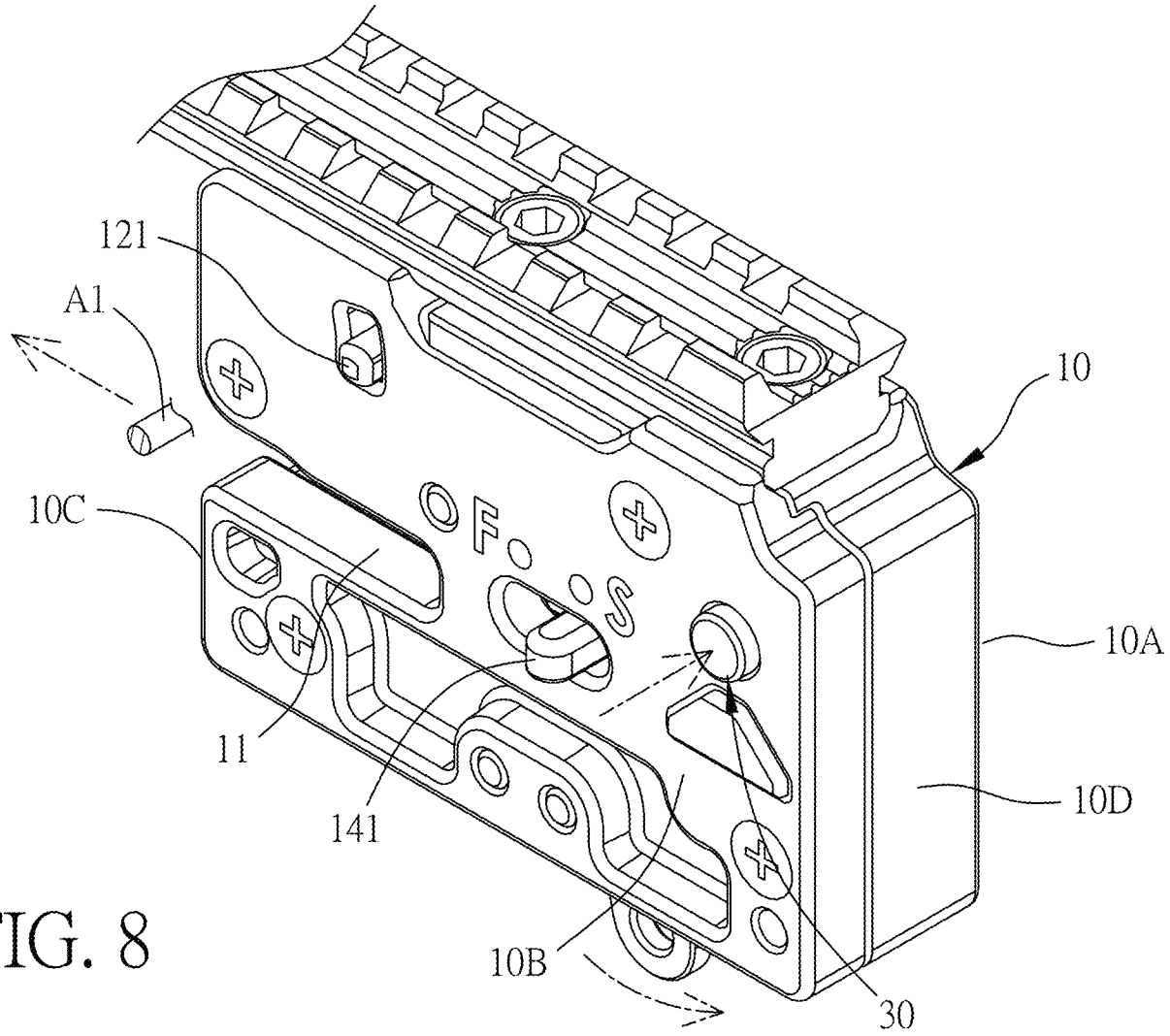
FIG. 8 is a three-dimensional view of a reset operation of the present disclosure.
Figure 9:
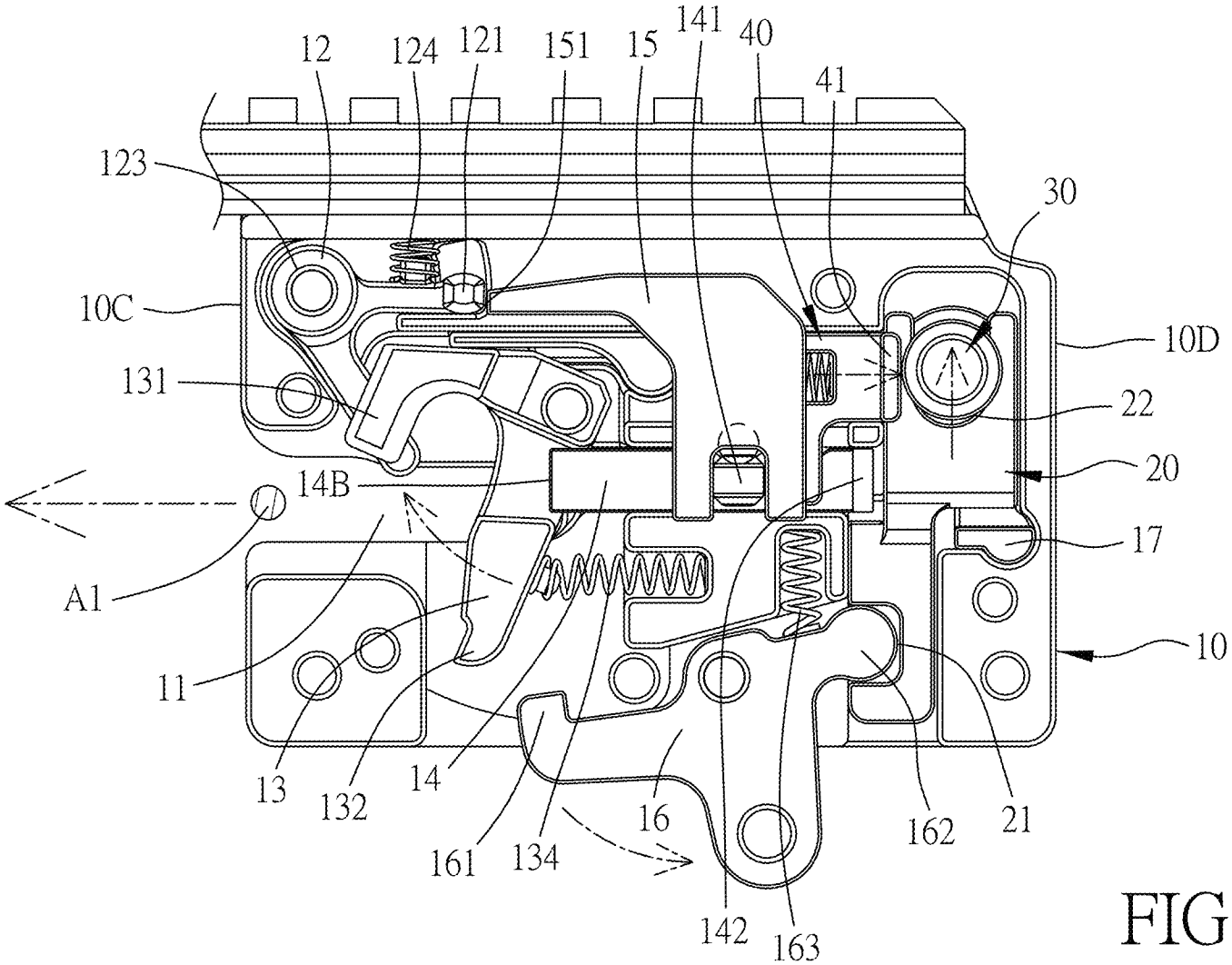
FIG. 9 is a planar view of a reset operation of the present disclosure.
Figure 10:
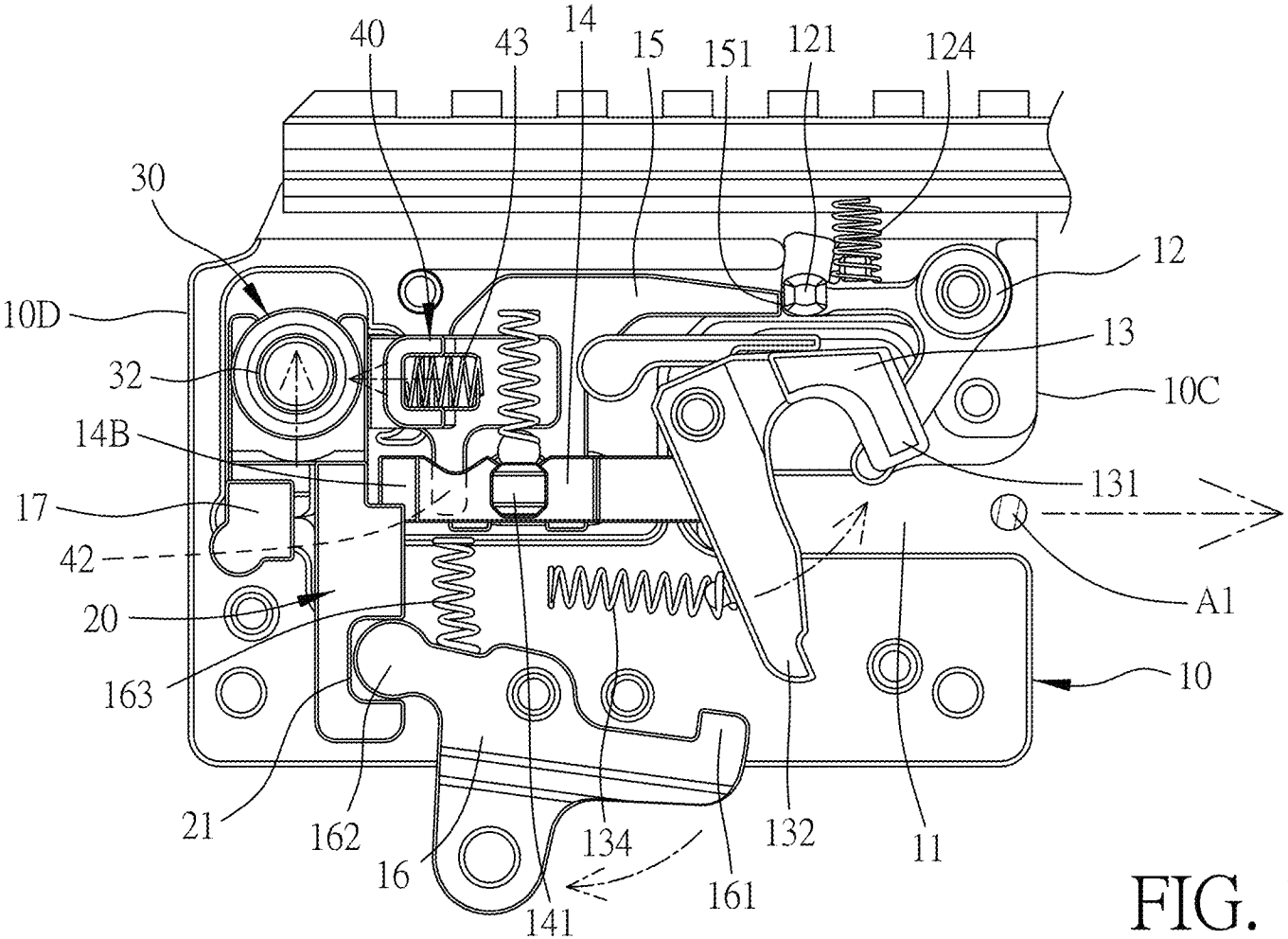
FIG. 10 is another planar view of a reset operation of the present disclosure.
Figure 11:
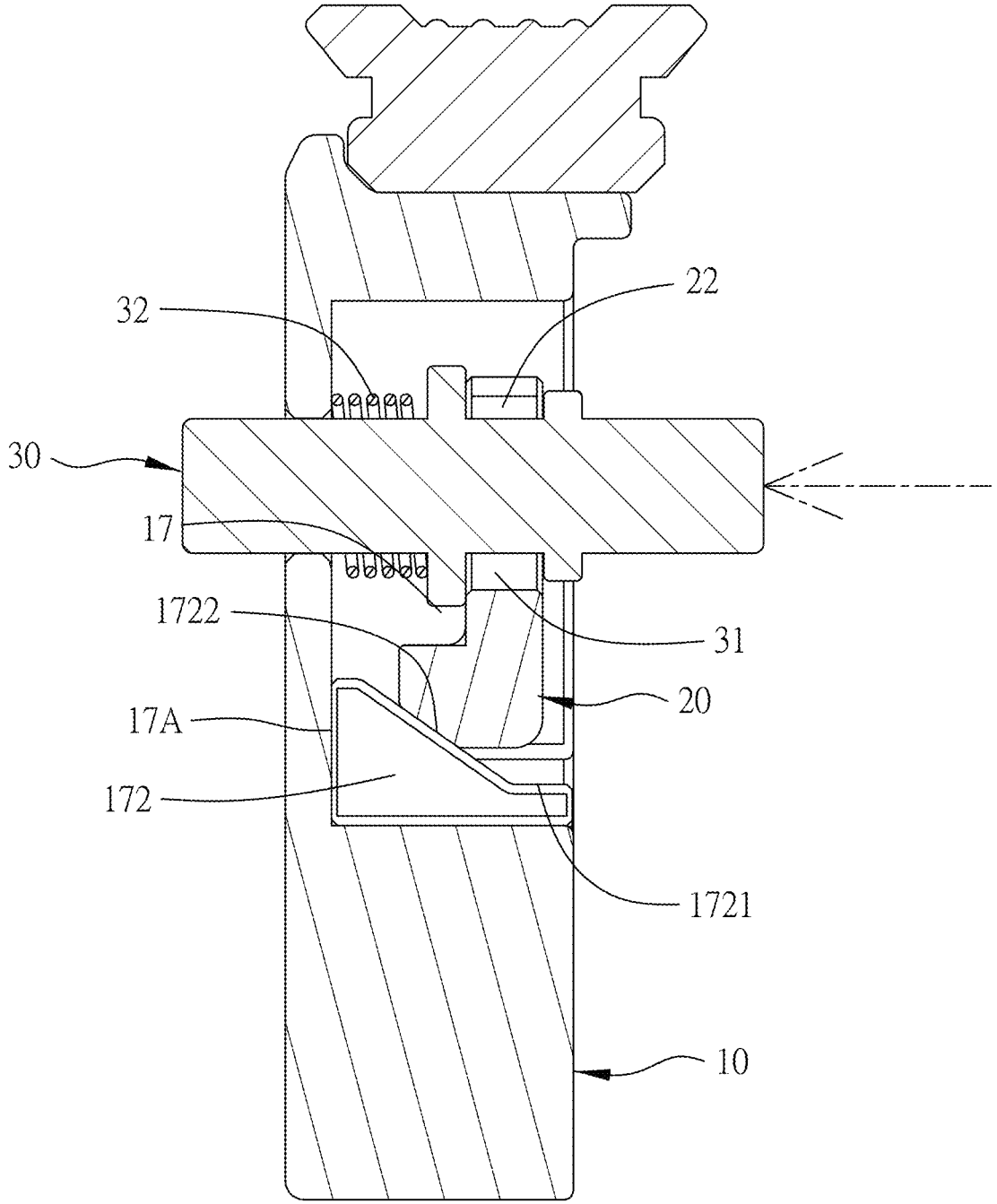
FIG. 11 is a cross-sectional view showing the pressing of a button during a reset operation of the present disclosure.
Figure 12:
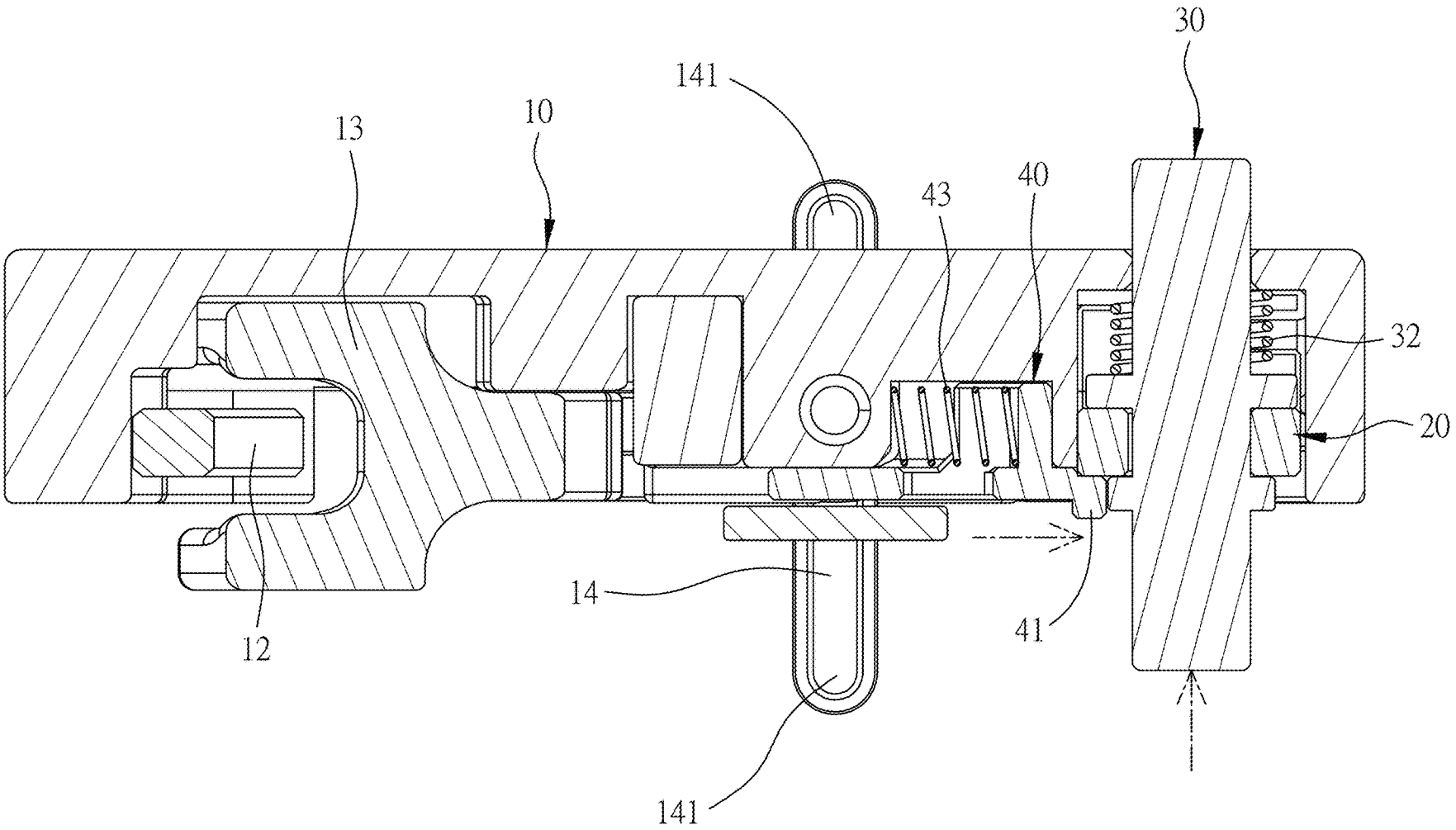
FIG. 12 is another cross-sectional view showing the pressing of a button during a reset operation of the present disclosure.
Figure 13:
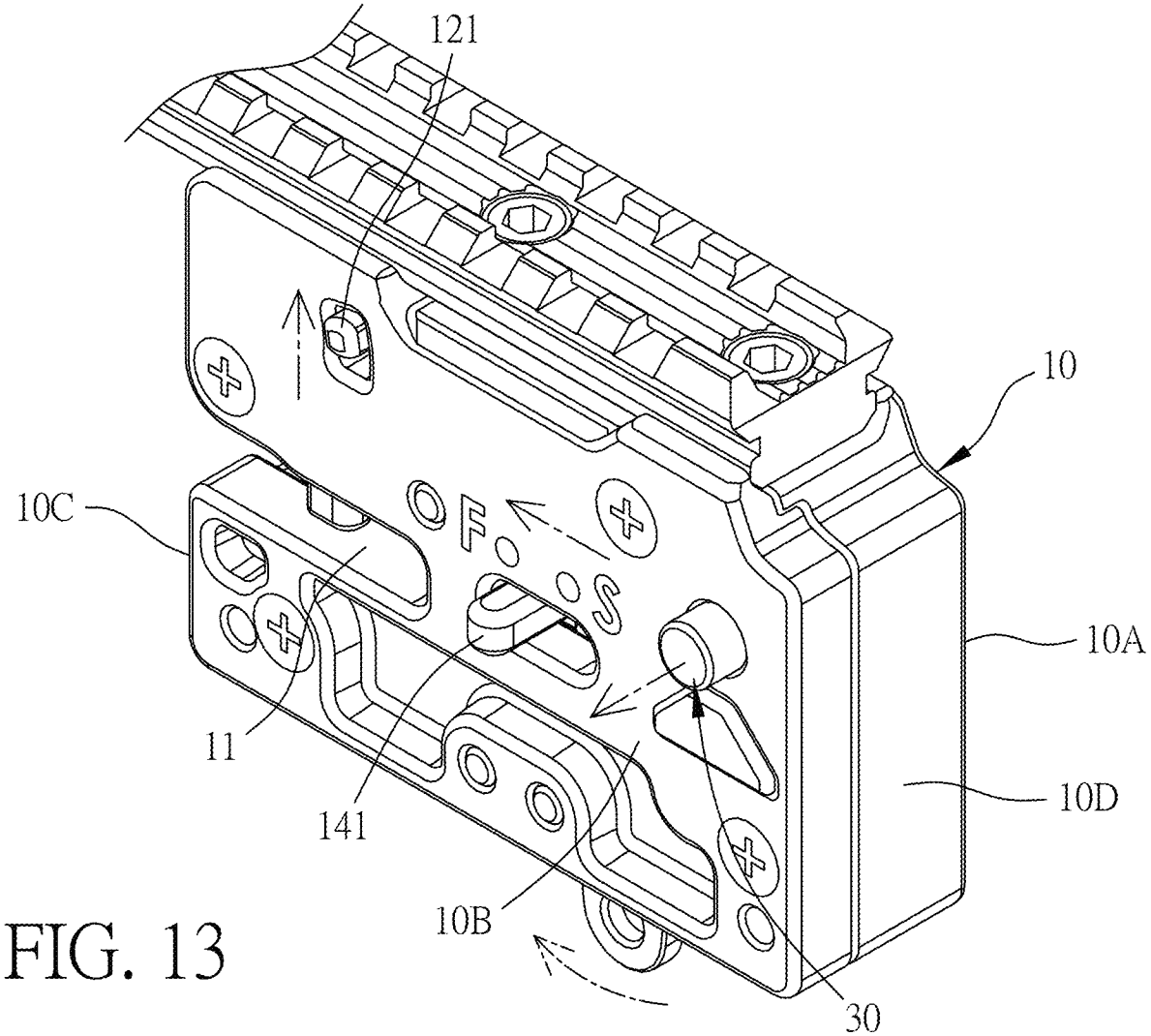
FIG. 13 is a three-dimensional view showing the operation of returning to the initial state of the present disclosure.

With reference to FIGS. 1 to 7 for a trigger reset device of the present disclosure, the trigger reset device includes a trigger block 10, a linkage part 20, a button 30 and a retractor 40.

The trigger block 10 is formed by a first cover 10A and a second cover 10B engaged with each other, and has a front end 10C and a rear end 10D. The trigger block 10 has an arrow placement channel 11 extends backward from a middle section of the front end 10C.

The trigger block 10 is pivotally installed with an arrow control seat 12 inside the trigger block 10 and near the front end 10C of the trigger block 10, a top support part 121 and a blocking part 122 are arranged in a direction of the arrow control seat 12, a first pivot part 123 is arranged in another direction of the arrow control seat 12, the blocking part 122 is disposed on top of the top support part 121, an end of the blocking part 122 protrudes outside the trigger block 10, the first pivot part 123 is a pivot hole, the arrow control seat 12 is pivotally combined with the trigger block 10 by the first pivot part 123, the arrow control seat 20 is pivoted by using the first pivot part 123 as an axis, and an arrow control seat spring 124 is installed between the arrow control seat 12 and the trigger block 10, so that the arrow control seat 12 is elastically abutted by the arrow control seat spring 124 in a direction towards the arrow placement channel 11.

The trigger block 10 is provided with a hooker 13 therein and on a rear side of the arrow control seat 12, the hooker 13 includes a string hooking part 131 installed at an end of the hooker 13 and a latching part 132 disposed at the other end of the hooker 13, a second pivot part 133 (which is a pivot hole in this embodiment) installed between the string hooking part 131 and the latching part 132, the hooker 30 is pivotally combined with the trigger block 10 by the second pivot part 133, and a hooker spring 134 is installed between the hooker 13 and the trigger block 10, so that the hooker 13 is elastically abutted by the hooker spring 134, and the latching part 132 is extended to the arrow placement channel 11.

Figure 14:
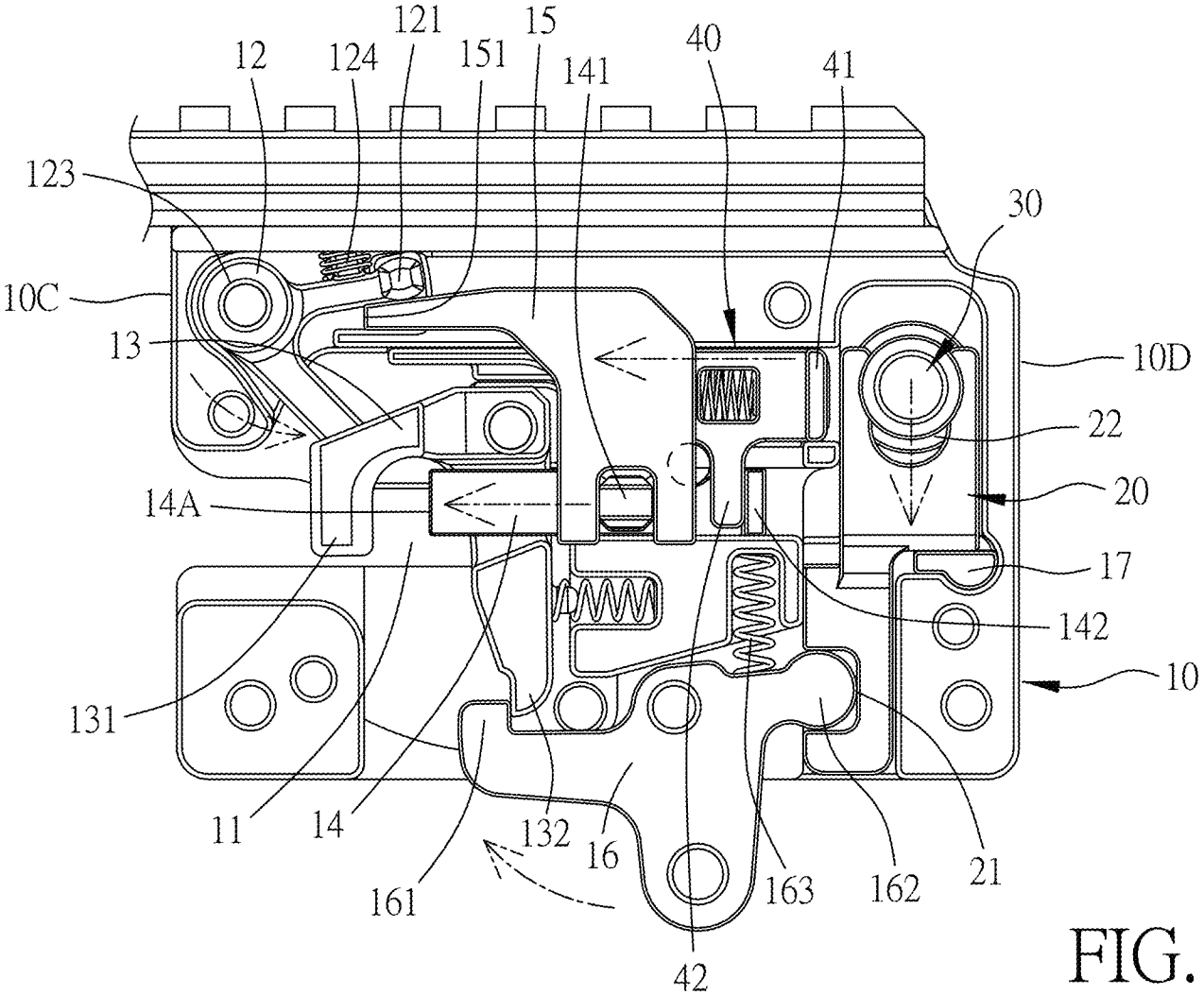
FIG. 14 is a planar view of the operation of returning to the initial state of the present disclosure.
Figure 15:
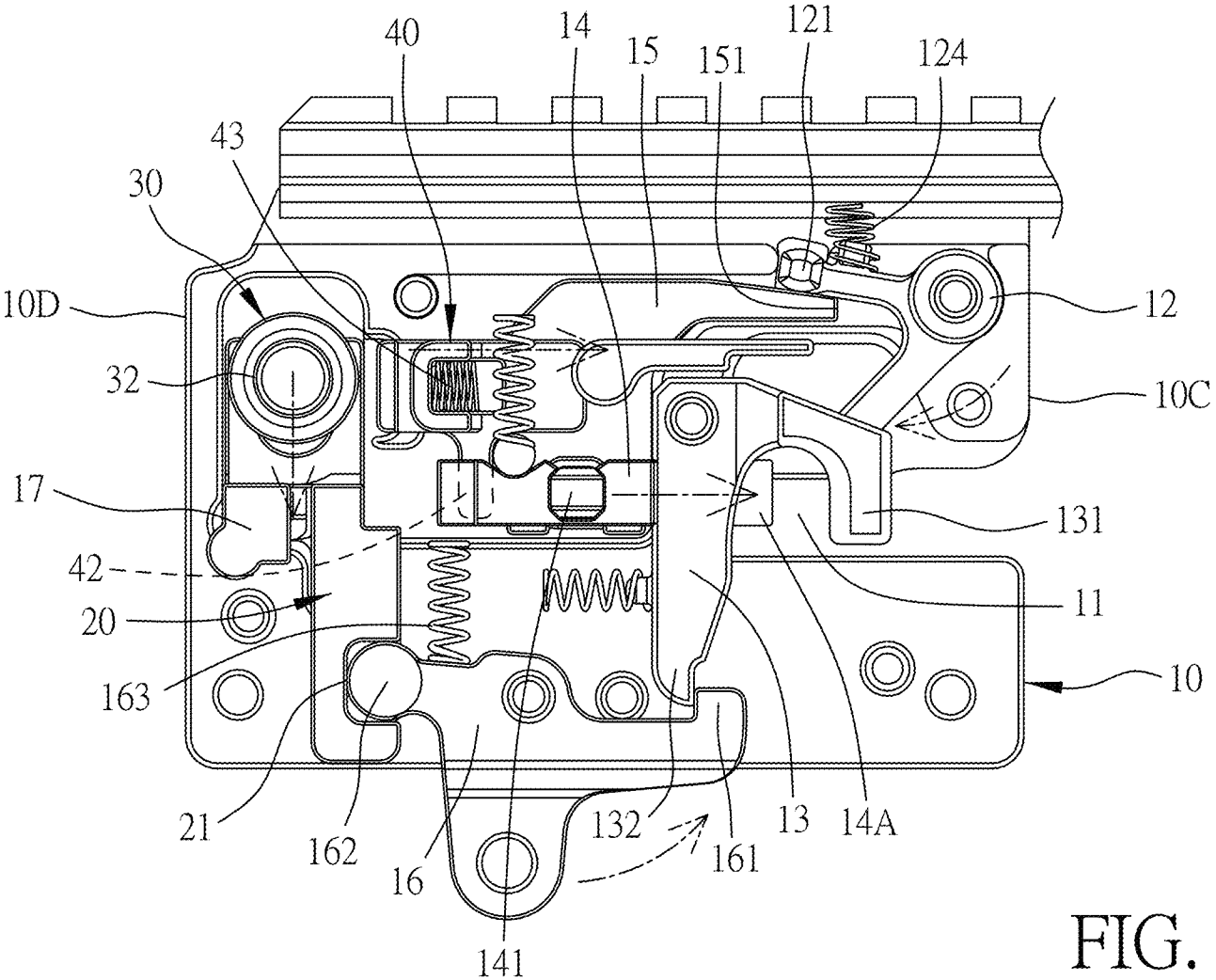
FIG. 15 is another planar view of the operation of returning to the initial state of the present disclosure.
Figure 16:
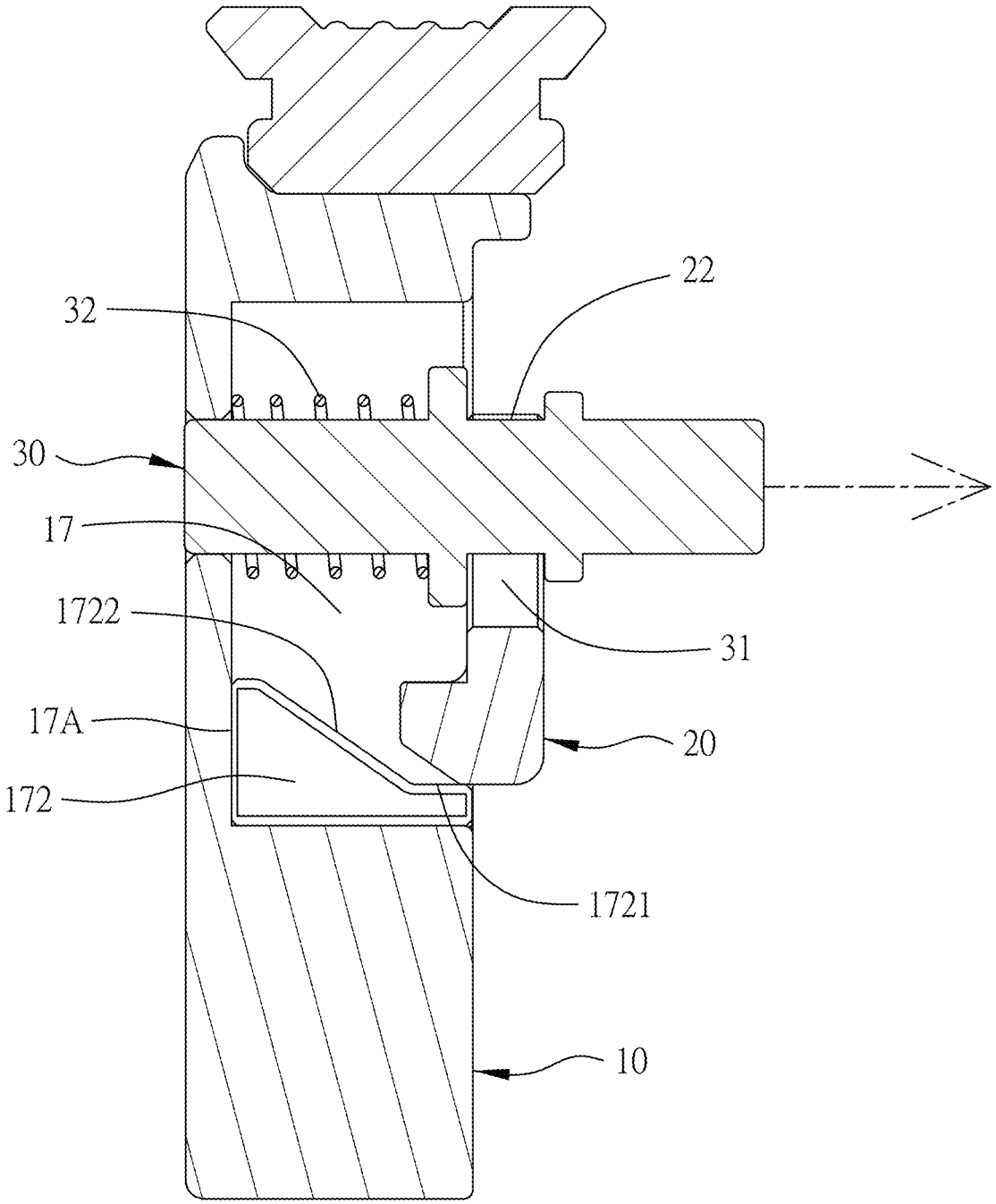
FIG. 16 is a cross-sectional view showing the releasing of a button of the present disclosure.
Figure 17:
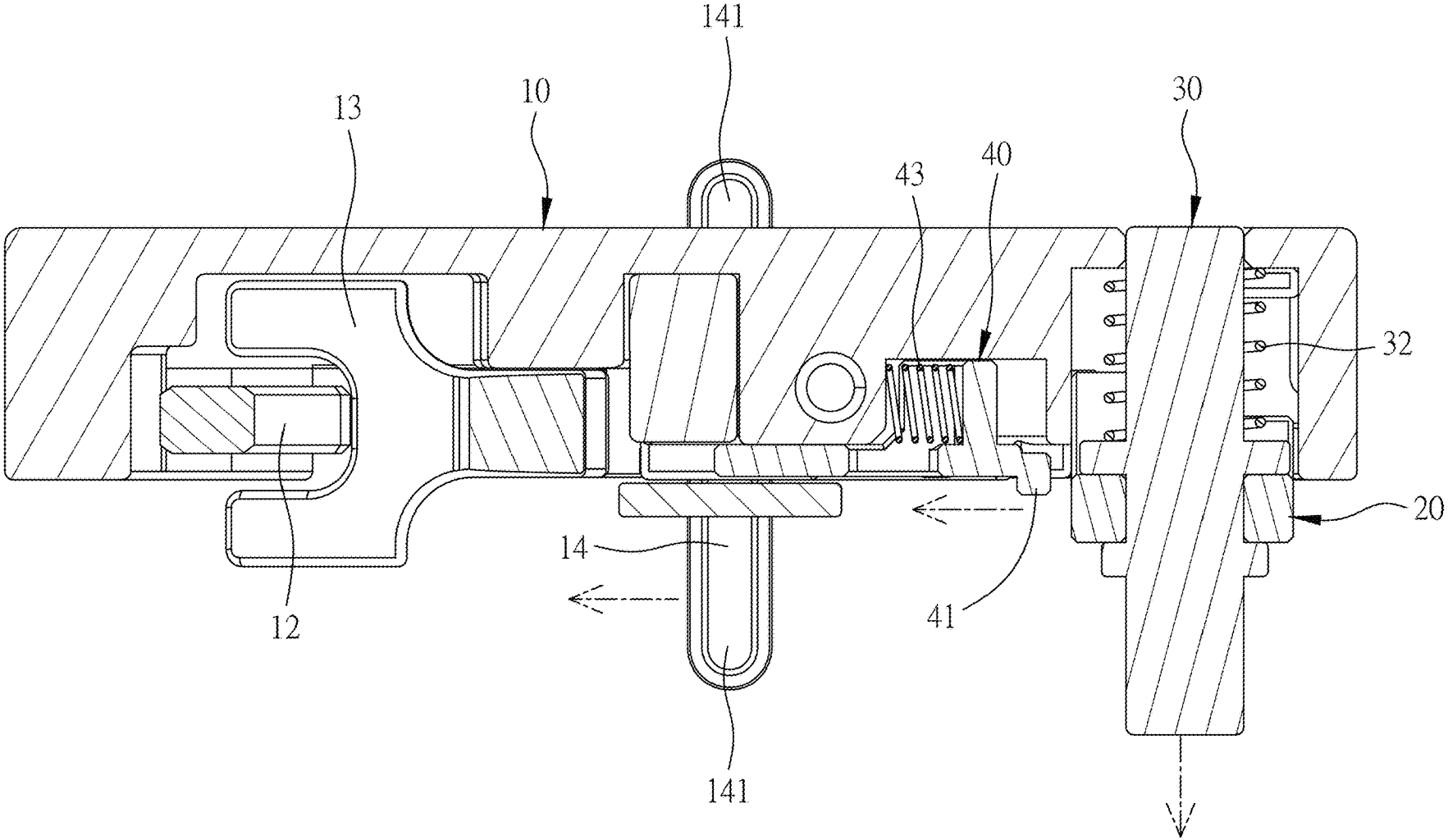
FIG. 17 is another cross-sectional view showing the release of a button of the present disclosure.

A safety switch 14 is installed in the trigger block 10 and on a rear side of the arrow placement channel 11, where the safety switch 14 is displaceably switched between an open position 14A (as shown in FIGS. 14 and 15) and a closed position 14B (as shown in FIGS. 4, 5, 9 and 10), the safety switch 14 is extended with at least one slide rod 141, the slide rod 141 protrudes outside the trigger block 10, and the safety switch 14 includes a driving part 142 disposed near the rear end, where two slide rods 141 are extended from both sides of the safety switch 14 of this embodiment respectively.

The trigger block 10 is combined with a brake member 15 extending forward on the safety switch 14, so that the brake member 15 displaces back and forth with the safety switch 14, and an end of the brake member 15 away from the safety switch 14 is provided with a blocked part 151.

The trigger block 10 is provided with a link trigger 16 near the bottom of the trigger block 10, an end of the link trigger 16 is provided with a hooking part 161 and the other end of the link trigger 16 is provided with a link part 162, the hooking part 161 is used for hooking and fixing the latching part 132 of the hooker 13, a link trigger spring 163 is installed between the link trigger 16 and the trigger block 10, so that the link trigger 16 is elastically abutted by the link trigger spring 163, and the link trigger 16 is normally maintained in an unfire status.

The trigger block 10 is provided with a linkage part receiving slot 17 near the rear end 10D of the trigger block 10, the linkage part receiving slot 17 includes a displacement means 17A with a step part 171 arranged in the middle section of the linkage part receiving slot 17, the step part 171 includes a guide block 172 having a flat guide surface 1721 connected to an upwardly inclined slanting guide surface 1722, and the trigger block 10 has a retractor receiving slot 18 formed in the trigger block 10 and configured to be corresponsive to the linkage part receiving slot 17.

The linkage part 20 is displaceably installed in the linkage part receiving slot 17 of the trigger block 10, the linkage part 20 is provided with a link slot 21 near the lower end of the linkage part 20, the link slot 21 is engaged and linked with the link part 162 of the link trigger 16, an upper end of the linkage part 20 is provided with a controlled part 22, where the controlled part 22 of this embodiment is a U-shaped slot, and when the safety switch 14 is in a closed position 14B, the linkage part 20 is blocked by the safety switch 14 to limit the linkage part 20 from sliding upward, which is to limit the link trigger 16 from being pressed and struck.

The button 30 includes a sliding sleeve part 31 which is used to slide ably combined with the controlled part 22 of the linkage part 20 and linked with the displacement means 17A, and a part of the button 30 protrudes outside the trigger block 10. By pressing the button 30 in conjunction with the displacement means 17A, the linkage part 20 can be driven to displace horizontally along the flat guide surface 1721 of the guide block 172 first, and then displace upwardly along the slanting guide surface 1722, a button spring 32 is installed between the button 30 and the trigger block 10, such that when the button 30 is released, the button spring 32 is provided for elastically abutting the button 30 to displace the button 30 downward and restore the button 30 to its original position.

The retractor 40 is installed into the retractor receiving slot 18 of the trigger block 10, an end of the retractor 40 facing towards the linkage part 20 is provided with a blocking part 41, a driven part 42 is extended downward, a retractor spring 43 is installed between the retractor 40 and the trigger block 10, and the retractor 40 is pushed towards the linkage part 20 to abut the linkage part 20 by the elastic force of the retractor spring 43.

In archery, as shown in FIGS. 4 to 7, a bowstring A1 is pulled backward to mount an arrow first, so that the bowstring A1 is hooked on the string hooking part 131 of the hooker 13 in a tensioned state, and the latching part 132 of the hooker 13 is latched by the hooking part 161 of the link trigger 16. At this time, the bowstring A1 is in an unloaded arrow state. The blocking part 122 of the arrow control seat 12 blocks the blocked part 151 of the brake member 15, and the safety switch 14 is limited by the brake member 15 from being switched from the closed position 14B to the open position 14A, so as to achieve the function of preventing the dry fire.

When it is necessary to reset the trigger, as shown in FIGS. 8 to 12, the safety switch 14 remains in the closed position 14B, and the bow tensioning device is used to pull the bowstring A1 backward, so that the bowstring A1 is separated from the hooker 13, and the hooker 13 no longer bears the pulling force of the bowstring A1, and then the button 30 is pressed to drive the linkage part 20 to displace horizontally along the flat guide surface 1721 of the guide block 172 first, so that the linkage part 20 is released from by blocking of the safety switch 14, and then the linkage part 20 displaces upward along the slanting guide surface 1722 of the guide block 172, so that the linkage part 20 drives the link trigger 16 to pivot, and the hooking part 161 of the link trigger 16 is separated from the latching part 132 of the hooker 13. At the same time, the linkage part 20 and the retractor 40 are staggered. The retractor 40 is pushed and displaced in the direction of the linkage part 20 by the retractor spring 43. The blocking part 41 of the retractor 40 is overlapped with the linkage part 20, so that the linkage part 20 is blocked by the blocking part 41 of the retractor 40. The hooker 13 is elastically abutted by the hooker spring 134, and the string hooking part 131 of hooker 13 is separated from the arrow placement channel 11, so that the bowstring A1 is no longer blocked by the string hooking part 131 of the hooker 13, and the bowstring A1 can be slowly restored by the bow tensioning device to complete the reset.

After the reset of the trigger, as shown in FIGS. 13 to 17, the blocking part 122 of the arrow control seat 12 protruding outside the trigger block 10 is pulled upward to drive the arrow control seat 12 to pivot. The blocking part 122 of the arrow control seat 12 no longer blocks the blocked part 151 of the brake member 15, and then the safety switch 14 is switched from the closed position 14B to the open position 14A, and the driving part 142 of the safety switch 14 abuts the driven part 42 of the retractor 40, so that the safety switch 14 drives the retractor 40 to displace in a direction away from the linkage part 20, the blocking part 41 of the retractor 40 is separated from the linkage part 20, and the linkage part 20 is no longer blocked and positioned by the blocking part 41 of the retractor 40. The button spring 32 elastically abuts the button 30 to restore the button 30 to its original position in cooperation with the link trigger spring 163 to restore the link trigger 16 to its original position, and simultaneously drives the linkage part 20 to return to the original position, thereby restoring the initial state.

With the above structure of the embodiment, the following advantageous effect can be achieved:

1. With the trigger reset device of the present disclosure, users simply need to press the button 30 to easily operate the link trigger 16 in order to detach the hooker 13, thereby realizing a quick reset function, improving the operating efficiency, and bringing a convenient and fast operating experience to the users.

2. The trigger reset device of the present disclosure has simple connections and operations between its components, thereby extending the service life of the product, not only reducing the cost of subsequent maintenance and replacement, but also ensuring long-term stable operation of the product.

While the first embodiments of the invention have been set forth for the purpose of disclosure, modifications of the disclosed embodiments of the invention as well as other embodiments thereof may occur to those skilled in the art. The scope of the claims should not be limited by the first embodiments set forth in the examples, but should be given the broadest interpretation consistent with the description as a whole.

What is claimed is:

1. A trigger reset device, comprising:

a trigger block, with a front end and a rear end, and consists an arrow placement channel extending backward from a middle section of the front end, a hooker pivoted into the trigger block, a safety switch installed at a rear side of the arrow placement channel inside the trigger block, the safety switch being displaceably switchable between an open position and a closed position and having at least one slide rod extending from the safety switch, and a driving part arranged on the safety switch, the trigger block being provided with a link trigger pivoted to the inside of the trigger block and near the bottom of the trigger block, an end of the link trigger being provided with a hooking part for hooking the hooker, another end of the link trigger being provided with a link part, the trigger block comprising a linkage part receiving slot formed inside thereof and near the rear end thereof, the linkage part receiving slot comprising a displacement means, and the trigger block comprising a retractor receiving slot formed therein and configured to be corresponsive to the linkage part receiving slot;

a linkage part, displaceably installed in the linkage part receiving slot of the trigger block, and having a link slot formed at the linkage part near a lower end of the linkage part, and engaged and linked with the link part of the link trigger, and a controlled part arranged at an upper end of the linkage part;

a button, combined with the controlled part of the linkage part, and linked with the displacement means, and capable of driving the linkage part to move upward by pressing the button in conjunction with the displacement means, and displacing the linkage part downward to restore to its original position by releasing the button; and a retractor, installed in the retractor receiving slot of the trigger block, and comprising a positioning retainer disposed on the retractor and arranged towards an end of the linkage part, a driven part extending downward and driven by the driving part of the safety switch, and a retractor spring installed between the retractor and the trigger block, wherein the retractor is pushed by the elastic force of the retractor spring towards the linkage part to abut the linkage part;

thereby, the button can be pressed to drive the linkage part to move upward, and then the linkage part drives the link trigger away from the hooker, while the linkage part and the retractor are staggered, and the retractor is moved toward the linkage part by the retractor spring, so as to block the linkage part by the positioning retainer of the retractor.

2. The trigger reset device according to claim 1, wherein the trigger block is formed by a first cover and a second cover engaged with each other.

3. The trigger reset device according to claim 1, wherein the trigger block is pivotally installed with an arrow control seat therein and near a front end thereof, a top support part and a blocking part are arranged in a direction of the arrow control seat, a first pivot part is arranged in an opposite direction, the blocking part is disposed on top of the top support part, an end of the blocking part protrudes outside the trigger block, an arrow control seat spring is installed between the arrow control seat and the trigger block, so that the arrow control seat is elastically abutted in a direction towards the arrow placement channel by the arrow control seat spring, a brake member is combined with the safety switch inside the trigger block, so that the brake member displaces back and forth with the safety switch, an end of the brake member away from the safety switch is provided with a blocked part, and the blocked part is locked by the blocking part of the arrow control seat.

4. The trigger reset device according to claim 1, wherein the hooker comprises a string hooking part disposed at an end thereof and a latching part disposed at another end thereof, and a hooker spring installed between the hooker and the trigger block, so that the hooker is elastically abutted by the hooker spring, and the latching part is extended to the arrow placement channel.

5. The trigger reset device according to claim 1, further comprises a link trigger spring installed between the link trigger and the trigger block, so that the link trigger is elastically abutted by the link trigger spring, and the link trigger is normally maintained in an unfire status, and a button spring installed between the button and the trigger block and provided for elastically abuts the button to return the button to its original position.

6. The trigger reset device according to claim 1, wherein the displacement means comprises a step part arranged in a middle section of the linkage part receiving slot, and the step part is provided with a flat guide surface coupled to an upwardly inclined slanting guide surface.

7. The trigger reset device according to claim 6, wherein the step part of the linkage part receiving slot is installed with a guide block, and the flat guide surface and the slanting guide surface are arranged on the guide block.

8. The trigger reset device according to claim 1, wherein the safety switch is in the closed position, the linkage part is blocked by the safety switch to limit the linkage part from sliding upward, the link trigger is unable to press and strike, and the safety switch links to a brake member extending forward.

9. The trigger reset device according to claim 1, wherein the button is provided with a sliding sleeve part, and the sliding sleeve part is provided for sliding and combining with the controlled part of the linkage part, and a portion of the button protrudes outside the trigger block.

10. The trigger reset device according to claim 1, wherein the trigger block is pivotally installed with an arrow control seat therein and near a front end thereof, and an end of the link trigger is provided with a hooking part for hooking and fixing the hooker to control the hooker.

* * * * *